US012031404B2

(12) United States Patent
Zhong et al.

(10) Patent No.: US 12,031,404 B2
(45) Date of Patent: Jul. 9, 2024

(54) SINGLE SLIP FRAC TOOL

(71) Applicant: Halliburton Energy Services, Inc., Houston, TX (US)

(72) Inventors: Xiaoguang Allan Zhong, Singapore (SG); Shobeir Pirayeh Gar, Carrollton, TX (US); Daniel Keith Moeller, Carrolton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/565,147

(22) Filed: Dec. 29, 2021

(65) Prior Publication Data

US 2023/0203911 A1 Jun. 29, 2023

(51) Int. Cl.

| | |
|---|---|
| ***E21B 33/129*** | (2006.01) |
| ***E21B 33/12*** | (2006.01) |
| ***E21B 33/128*** | (2006.01) |
| ***E21B 43/26*** | (2006.01) |

(52) U.S. Cl.

CPC ..... *E21B 33/129* (2013.01); *E21B 33/1208* (2013.01); *E21B 33/128* (2013.01); *E21B 43/26* (2013.01)

(58) Field of Classification Search

CPC ..... E21B 23/06; E21B 23/01; E21B 23/0413; E21B 43/26; E21B 33/128; E21B 33/1208; E21B 33/129

See application file for complete search history.

(56) References Cited

U.S. PATENT DOCUMENTS

| | | | | |
|---|---|---|---|---|
| 5,701,959 | A | 12/1997 | Hushbeck et al. | |
| 6,394,180 | B1 | 5/2002 | Berscheidt et al. | |
| 7,740,079 | B2 | 6/2010 | Clayton et al. | |
| 8,047,279 | B2 | 11/2011 | Barlow et al. | |
| 8,113,276 | B2 | 2/2012 | Greenlee et al. | |
| 8,403,036 | B2 | 3/2013 | Neer et al. | |
| 8,770,276 | B1 | 7/2014 | Nish et al. | |
| 8,875,799 | B2 | 11/2014 | Smith et al. | |
| 9,580,981 | B2 | 2/2017 | Zhong et al. | |
| 9,835,003 | B2 | 12/2017 | Harris et al. | |
| 10,233,720 | B2 | 3/2019 | Tse et al. | |
| 10,408,012 | B2 * | 9/2019 | Martin | E21B 33/1277 |
| 10,428,616 | B2 | 10/2019 | Dirocco | |
| 11,365,600 | B2 | 6/2022 | Greenlee et al. | |
| 2013/0186649 | A1 * | 7/2013 | Xu | E21B 23/00 166/382 |

(Continued)

OTHER PUBLICATIONS

Halliburton Catalog, Completion Tools, pp. 5-24 through 5-34 (undated but admitted to be prior art).

(Continued)

*Primary Examiner* — Theodore N Yao
(74) *Attorney, Agent, or Firm* — McAfee & Taft

(57) ABSTRACT

A frac plug defines a central passage therethrough and is movable from an unset to a set position in a well casing. A single slip ring assembly is supported by the bottom shoe and a slip wedge is positioned in slidable relationship to the single slip ring assembly. A sealing element is supported by the slip wedge. A deformable ball seat is movable axially relative to the sealing element and the sealing element is expandable radially outwardly to engage and seal against the well casing upon the application of a force applied thereto by the deformable ball seat.

18 Claims, 7 Drawing Sheets

(56) References Cited

U.S. PATENT DOCUMENTS

| | | | | |
|---|---|---|---|---|
| 2014/0311752 | A1 | 10/2014 | Streich et al. | |
| 2015/0226047 | A1 | 8/2015 | Robb et al. | |
| 2016/0097255 | A1* | 4/2016 | Doane | E21B 43/26 166/308.1 |
| 2017/0260825 | A1* | 9/2017 | Schmidt | E21B 33/12 |
| 2018/0245422 | A1 | 8/2018 | Fripp et al. | |
| 2018/0363409 | A1 | 12/2018 | Frazier | |
| 2019/0162044 | A1* | 5/2019 | Dirocco | E21B 23/06 |
| 2019/0292874 | A1 | 9/2019 | Saeed | |
| 2019/0352998 | A1* | 11/2019 | Wolf | E21B 33/1285 |
| 2020/0115988 | A1 | 4/2020 | Wilcox et al. | |
| 2020/0157914 | A1 | 5/2020 | Graham et al. | |
| 2021/0054704 | A1 | 2/2021 | Merron et al. | |
| 2021/0293113 | A1 | 9/2021 | Pelto | |
| 2022/0120151 | A1* | 4/2022 | Jacob | E21B 23/01 |
| 2023/0203912 | A1 | 6/2023 | Zhong et al. | |

OTHER PUBLICATIONS

Halliburton Catalog, "Liner Hanger Systems," Completion Tools, pp. 7-1 through 7-22 (undated but admitted to be prior art).

* cited by examiner

SINGLE SLIP FRAC TOOL

BACKGROUND

Fracturing plugs, or "frac plugs" are designed to set inside a wellbore and divide the wellbore into zones. Frac plugs generally act like one-way valves to allow flow in one direction. Single slip frac plugs used in wellbores only take differential pressure from above, thus no need to for bi-directional slips. When a setting tool is removed prior art single slip frac rely solely on the friction between the element and casing inner diameter. There are times when the friction force alone may not be enough to hold the frac plug in place.

BRIEF DESCRIPTION OF THE DRAWINGS

FIG. 6 is a cross section of the frac plug of FIG. 5 in a set position.

DESCRIPTION OF A PREFERRED EMBODIMENT

Figure 1:
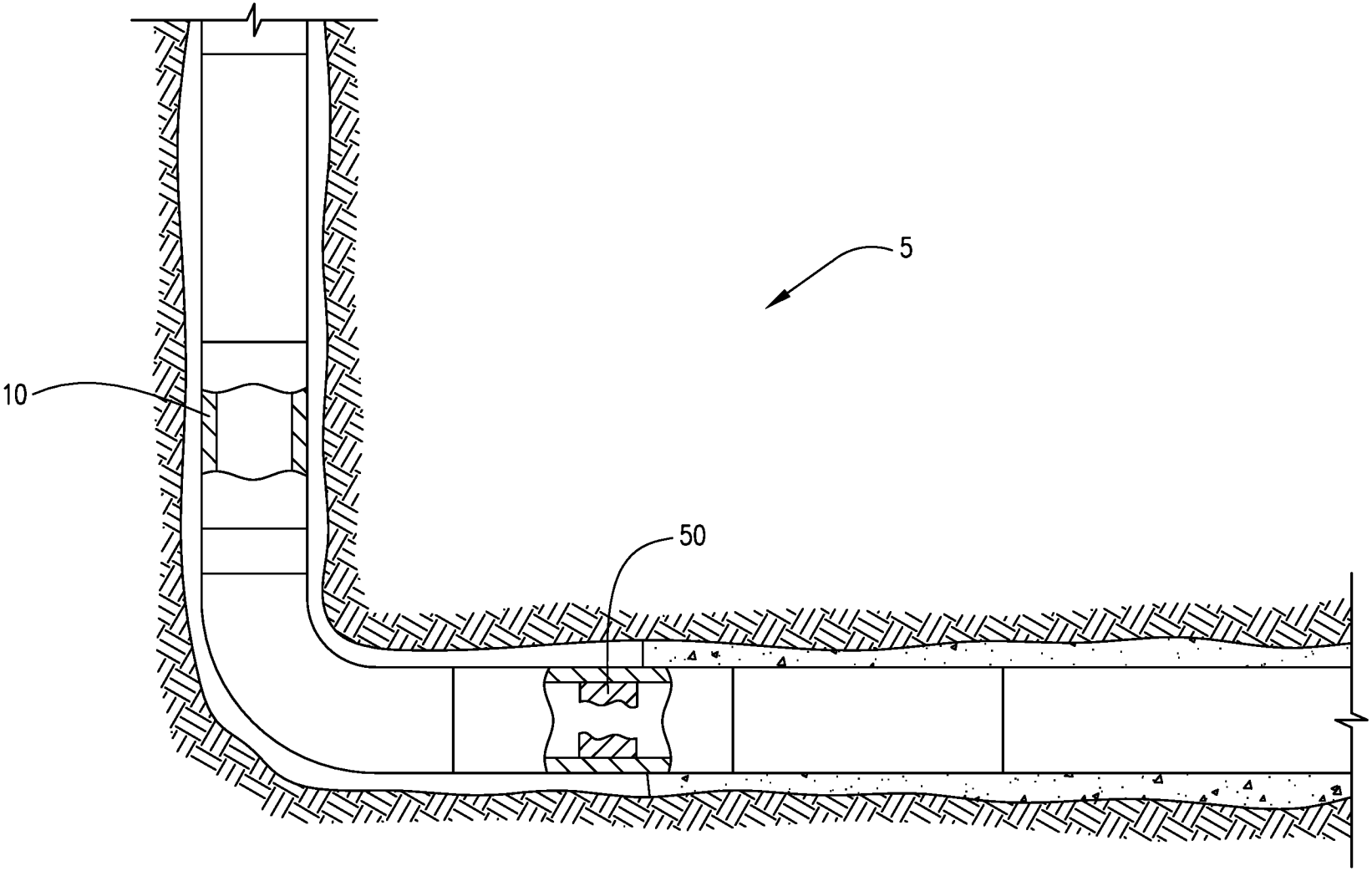
FIG. 1 is a schematic of a cased well with a frac plug therein.
Figure 2:
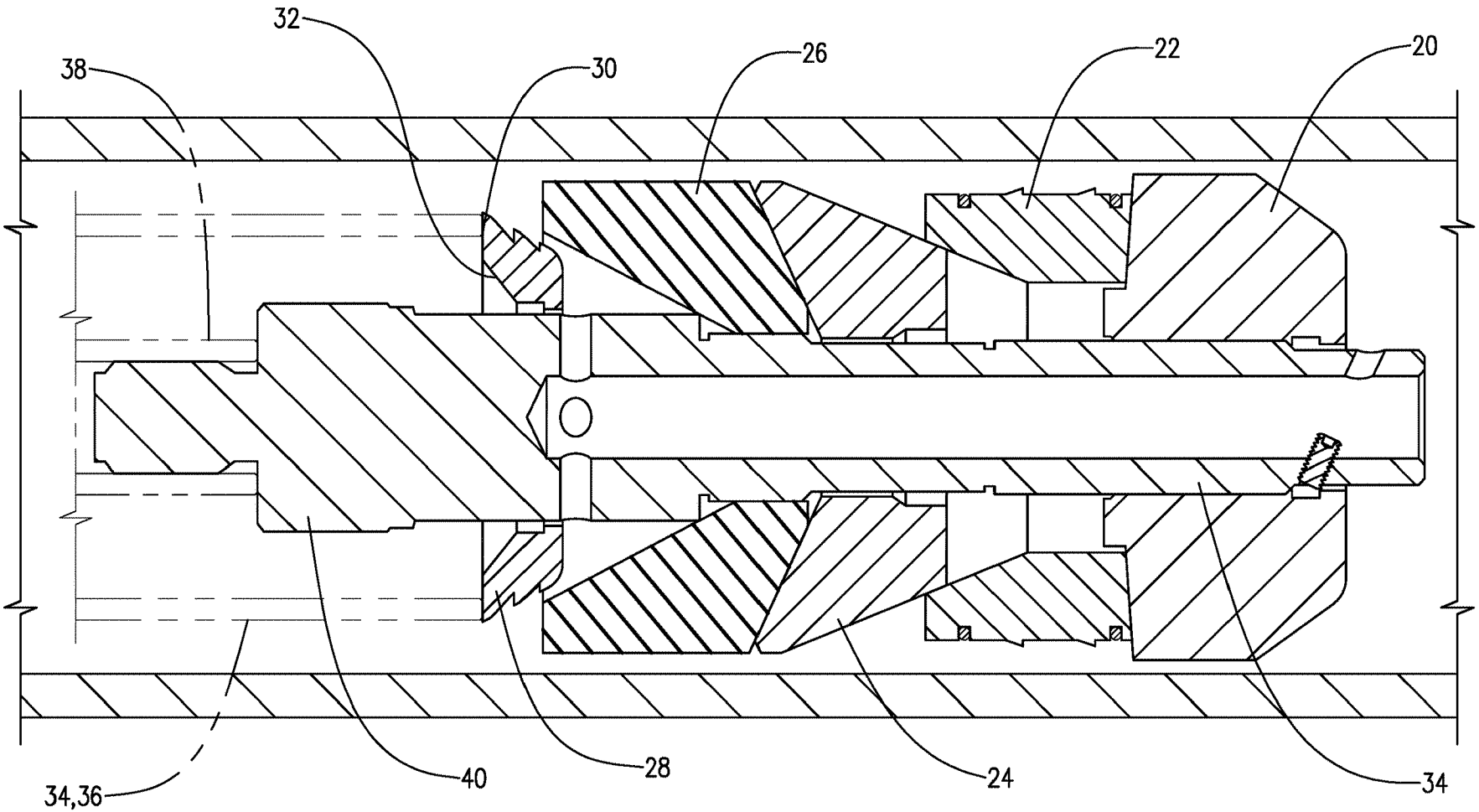
FIG. 2 PRIOR ART
FIG. 2 is a cross section of a prior art frac plug.
Figure 3:
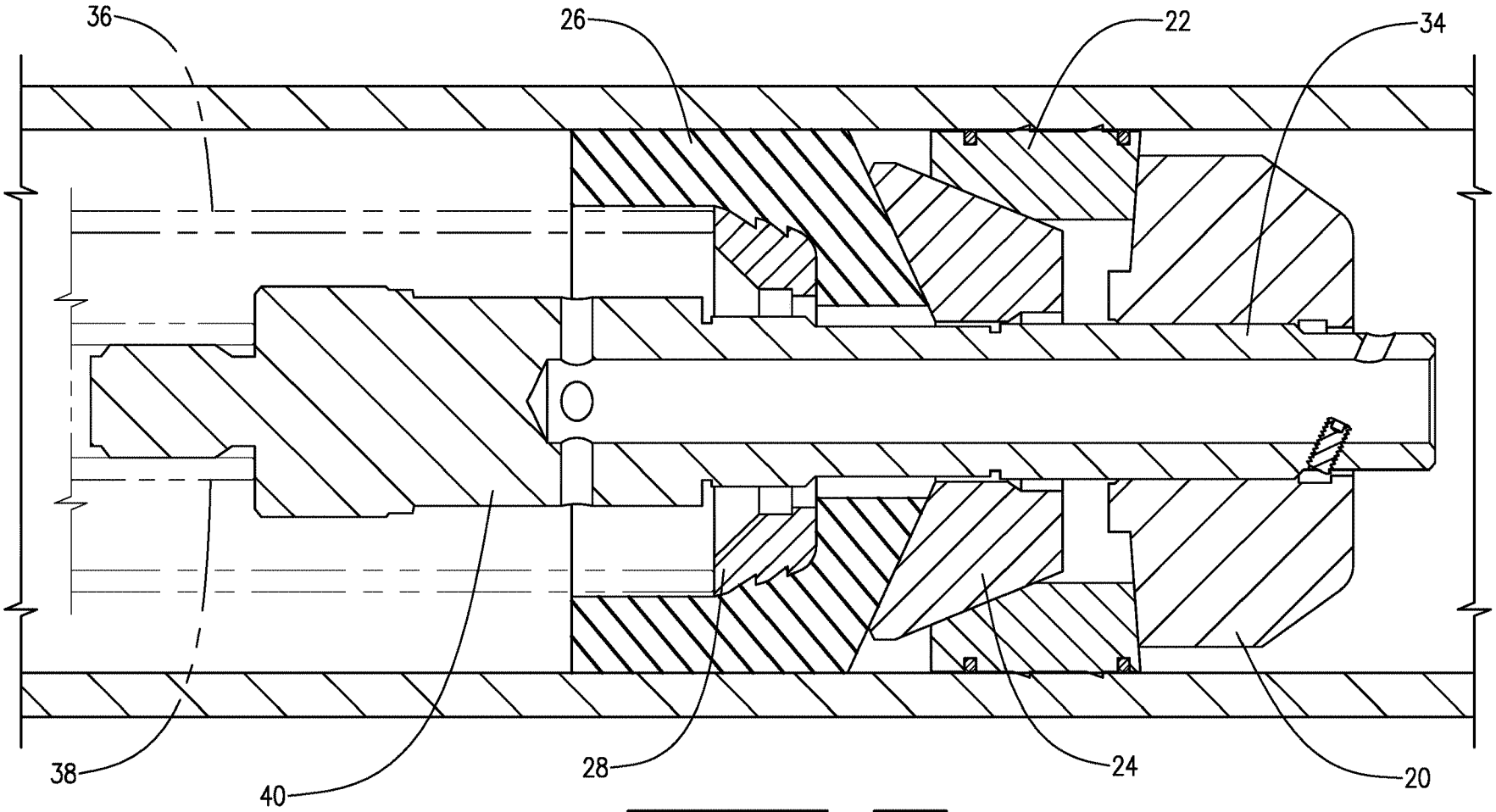
FIG. 3 PRIOR ART
FIG. 3 is a cross section of the prior art frac plug in a set position.
Figure 4:
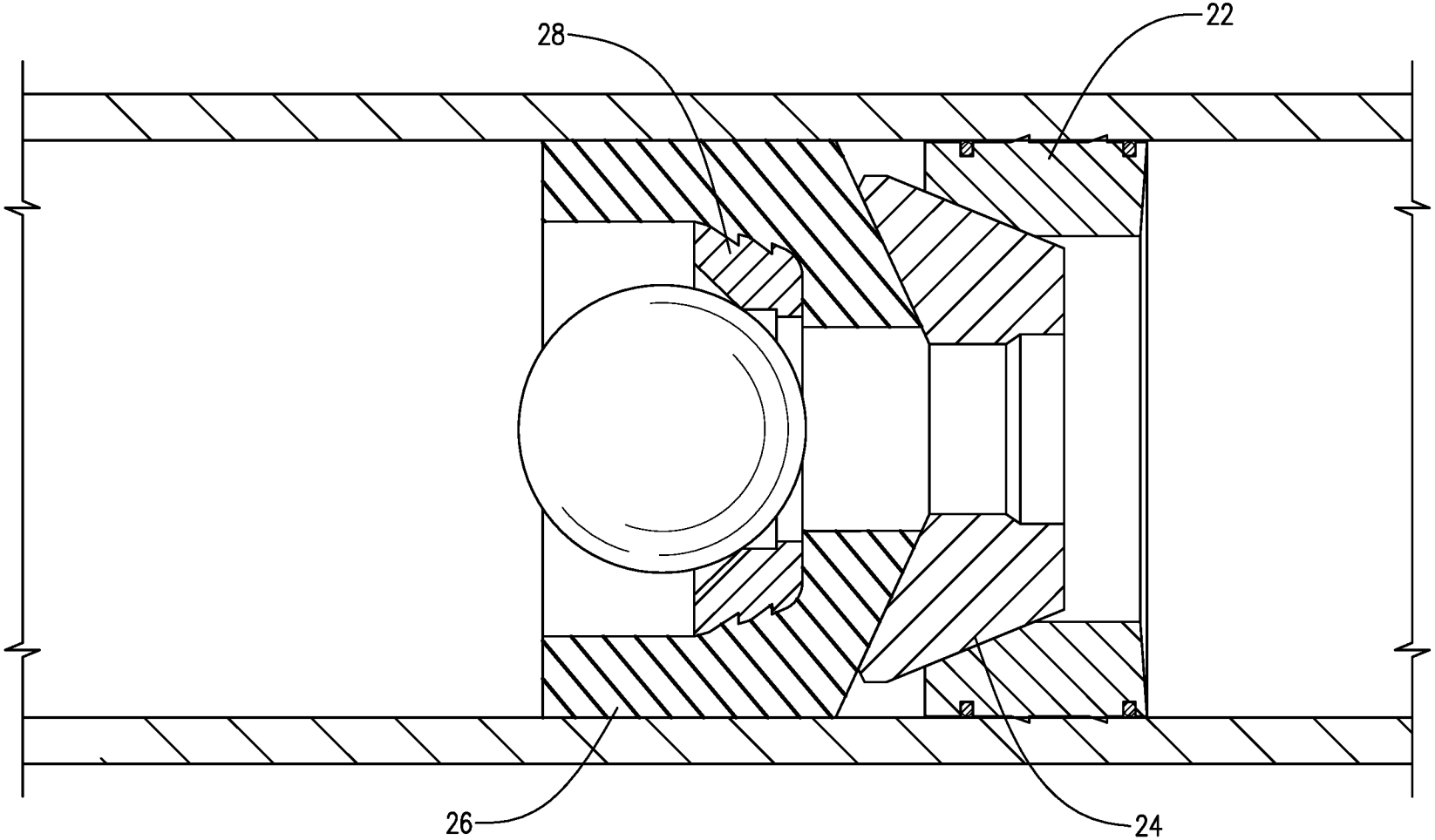
FIG. 4 PRIOR ART
FIG. 4 is a cross section of the prior art frac plug in a set position with the setting tool removed.

FIG. 1 schematically shows a well 5 with a casing 10 disposed therein. FIGS. 2-4 show cross sections of a prior art single slip frac plug. Prior art frac plug 15 comprises a bottom shoe 20, a slip assembly 22 supported thereon, a slip wedge 24, and a sealing element 26 supported by the slip wedge 24. A ball seat 28 is positioned in sealing element 26 in a set position of the prior art frac plug 15. Ball seat 28 has top surface 30 and inner surface 32, which is generally conically shaped. A setting tool 34 is connected at a lower end thereof to bottom shoe 20. An inner sleeve, or mandrel 38 of the setting tool 34 is connected to a head or adapter 40 and a setting sleeve 36 which is an outer sleeve 36 engages ball seat 28. An upward pull is applied to head 40 by inner sleeve 38 which creates a compressive force. Ball seat 28 is pressed downwardly into sealing element 26 until sealing element 26 engages a casing disposed in a well. A setting load is predetermined at which setting tool 34 will shear from the bottom shoe 20 and will be removed. A compressive force is applied to the top surface 30 of ball seat 28 by setting sleeve 36. The compressive force moves the ball seat 28 down relative to sealing element 26, and moves frac plug 15 to the set position shown in FIG. 3. Once the frac plug 15 is set, the setting tool 34 is detached and removed as shown in FIG. 4.

Once the setting tool 34 is removed friction between the casing and the sealing element 26 is relied upon to keep the frac plug 15 in the set position. Single slip frac plugs generally only take differential pressure from above and as a result there is no need for bidirectional slips. However, with prior art single slip frac plugs as described there is a risk of the frac plug becoming unset as it relies solely on friction between the sealing element and the inner diameter of the casing.

Figure 5:
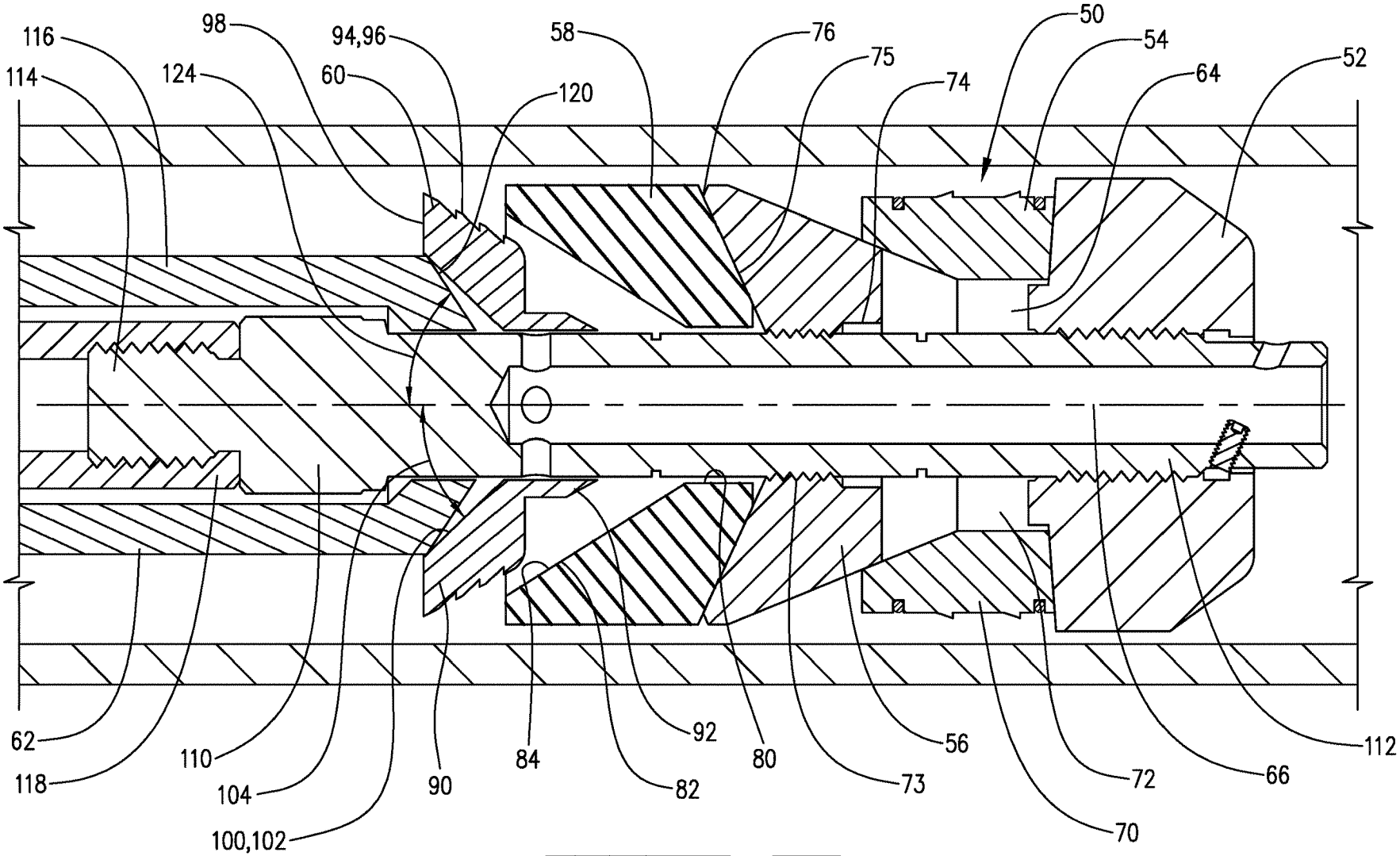
FIG. 5 is a cross section of a single slip frac plug of the current disclosure.
Figure 5:
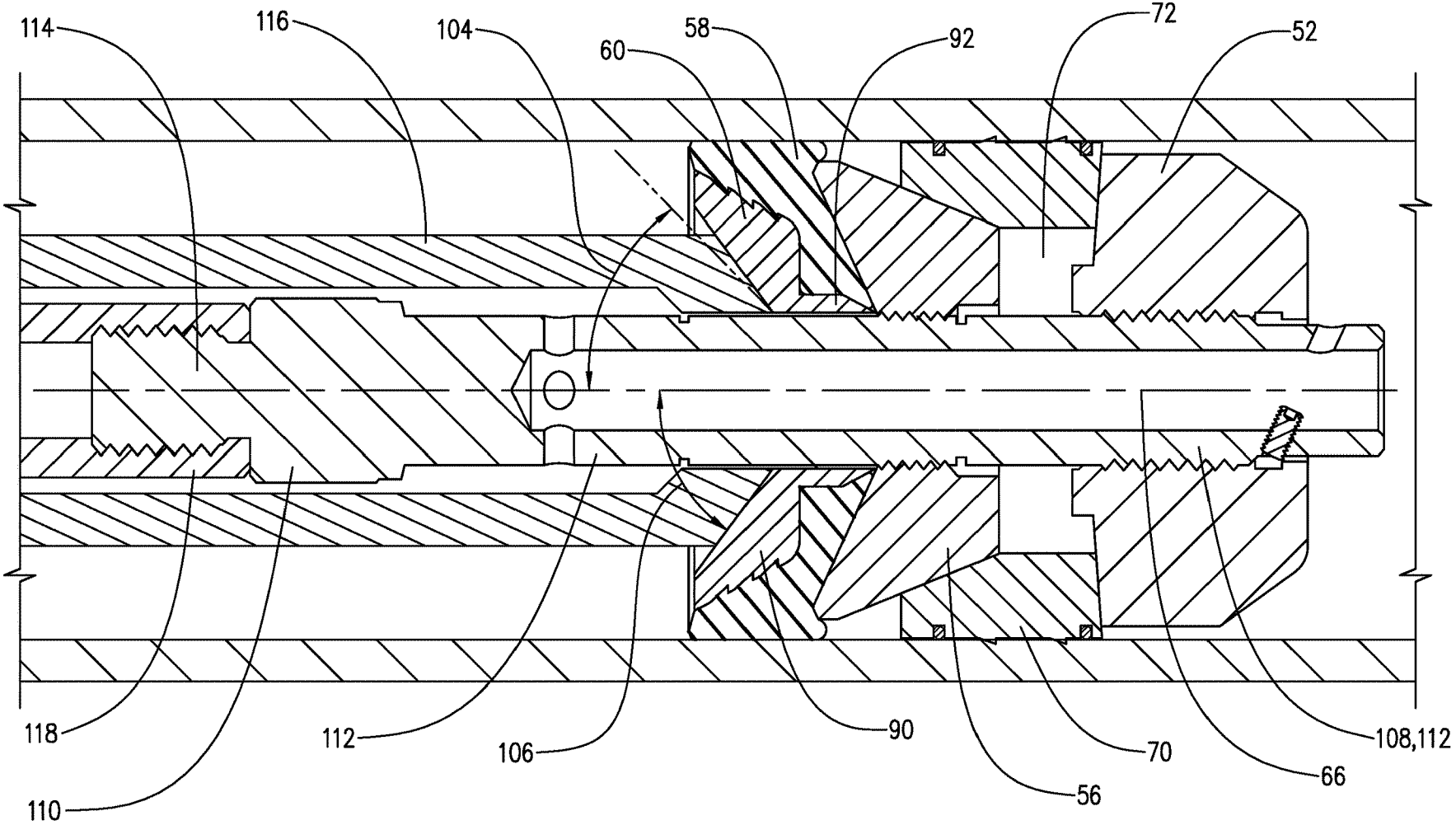
Figure 7:
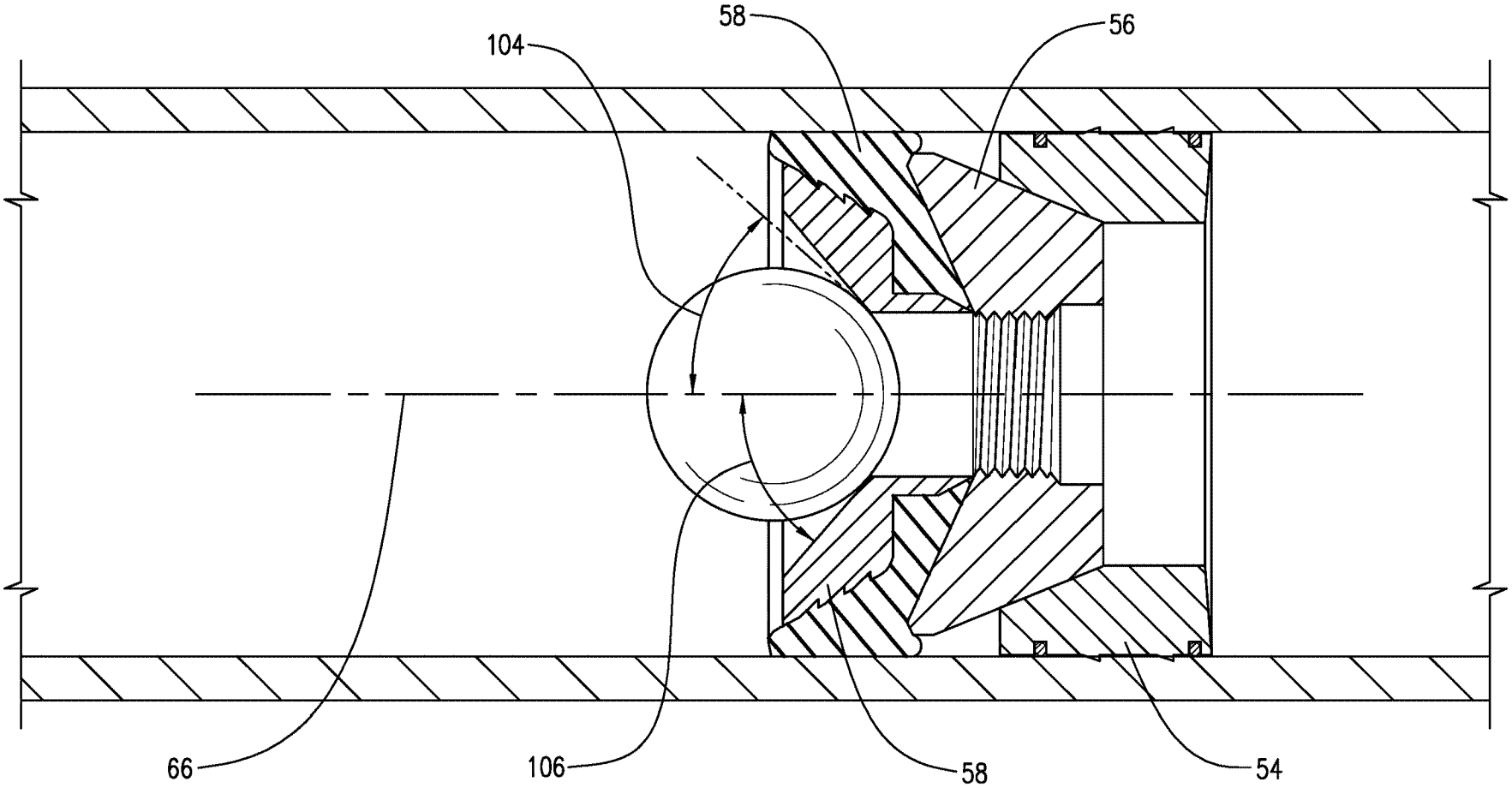
FIG. 7 is a cross section of the frac plug of FIG. 5 in a set position with the setting tool removed.

A frac plug 50 disclosed and claimed herein is a single slip frac plug 50. Single slip frac plug 50 is shown in FIGS. 5-7 and may be disposed in casing 10. Frac plug 50 may comprise a bottom shoe 52, a slip assembly 54 supported by the bottom shoe 52, a slip wedge 56 positioned above and in slidable relation to slip assembly 54 and a sealing element 58 supported by slip wedge 56. Slip ring assembly 54 is movable radially outwardly to engage the well in the set position of the frac plug 50. A ball seat 60 and setting tool 62 are utilized to move frac plug 50 and sealing element 58 from the unset position shown in FIG. 5 to the set position shown in FIG. 6. Setting tool 62 applies a compressive setting load as will be explained in more detail hereinbelow. Ball seat 60 in one embodiment is an expandable ball seat that may be for example a plastically deformable ball seat. Ball seat 60 will move from the relaxed state in FIG. 5 to the deformed state in FIG. 6 and once moved will stay in the deformed state. The plastic deformation of the ball seat 60 will hold the sealing element 58 in place and will help to prevent the sealing element 58 from losing its frictional grip on casing 10. Deformed ball seat 60 applies a radially outwardly directed force to the sealing element 58 so that it will aid in maintaining the frac plug 50 in its set position.

Frac plug 50 defines longitudinal central flow passage 64 therethrough and has longitudinal central axis 66. Bottom shoe 52 defines a central opening 68. Setting tool 62 is detachably connected to bottom shoe 52 with shearable threads or by other means known in the art. Slip ring assembly 54 is of a type known in the art and may comprise a plurality of slip elements 70. Slip ring assembly 54 is supported by bottom shoe 52. Slip ring assembly 54 has an opening 72 therein through which setting tool 62 passes. Slip ring 54 is expandable and will grippingly engage casing 10 in the set position of the frac tool 50. Slip wedge 56 is positioned atop and is supported by slip ring assembly 54. Slip wedge 56 is positioned in slidable relation to the slip ring 54 such that axial relative movement between the two will urge slip assembly 54 outwardly into engagement with the casing 10. Slip wedge 56 has a generally cylindrical opening 74 through which setting tool 62 passes. Slip wedge 56 may be connected to setting tool 62 with shearable threads 73. Slip wedge 56 has an outwardly sloping upper surface 75 from the opening 74 to an upper end 76 thereof.

Sealing element 58 defines a generally cylindrical opening 80 with a radially outwardly sloping inner surface 82 defining an inner engagement profile 84.

Deformable ball seat 60 is insertable into the opening of the sealing element and movable from the relaxed position shown in FIG. 5 to the deformed position shown in FIG. 6. Deformable ball seat 60 will engage sloping inner surface 82 of sealing element 58. Ball seat 60 is in one embodiment a plastically deformable ball seat 60. Ball seat 60 may comprise a ball seat body 90 with a lip 92 extending downwardly therefrom. In at least one embodiment the lip 92 will extend into central opening 80 of sealing element 58 in the set position of the frac plug 50. Deformable ball seat 60 will hold its shape once deformed from a relaxed position as shown in FIG. 5 to the position shown in FIG. 6. Ball seat 60 has an outer surface 94 that defines an outer engagement profile 96 that will engage inner engagement profile 84 of sealing element 58.

Ball seat 60 has top surface 98 and inner surface 100 defined on ball seat body 90. Inner surface 100 of ball seat body 90 is a sloped inner surface 100 that defines an inner engagement profile 102 which is a sloped inner engagement profile. Inner engagement profile 102 defines a first acute angle 104 with longitudinal central axis 66 in the unset position in which ball seat 60 is in a relaxed, non-deformed condition. In some embodiments when moved to the set position, the ball seat 60 is deformed such that inner engagement profile 102 defines a second acute angle 106 that is greater than first acute angle 104.

Setting tool 62 may be utilized to move frac plug 50 from the unset to the set position. Setting tool 62 operates like a standard setting tool in that setting tool 62 applies a compressive force to move the frac plug 50 from the unset to the set position. However, setting tool 62 is configured differently than the standard setting tool 34, and engages the ball seat in a different location. Setting tool 62 is shaped so that a radially outwardly directed force will be applied to sloped inner surface 100 of ball seat 60 to expand ball seat 60 radially outwardly as the frac plug 50 is moved to the set position.

Setting tool 62 has connecting member 108 comprising a head portion 110 with a shaft 112 extending downwardly therefrom. An adapter 114 extends upwardly from head portion 110. Shaft 112 extends downwardly into and is connected to bottom shoe 52. The connection is a detachable connection so that shaft 112 will detach from bottom shoe 52 after frac plug 50 is moved to the set position. Bottom shoe 52 will fall to the bottom of the well after disconnection. Setting tool 62 likewise includes an outer mandrel, or setting sleeve 116 which will engage ball seat 60 and an inner mandrel 118 that will connect to adapter 114. In the disclosed embodiment, setting sleeve 116 has a sloped engagement surface 120 defining a setting sleeve engagement profile 122. Setting sleeve engagement profile 122 defines an angle 124 with longitudinal central axis 66. Angle 124 is an acute angle, and in the unset position angle 124 is greater than first acute angle 104 defined by ball seat 60. In other embodiments the angle may be the same, or less than angle 104.

Once single slip frac plug 50 has been lowered into the casing 10 to a desired location, setting sleeve 62 may be activated to move the frac plug from the unset to the set position. Setting sleeve 62 is activated to apply a compressive force to frac plug 50 to move the frac plug to the set position. The activation of setting sleeve 62 may be done so in a manner known in the art.

When setting tool 62 is activated inner mandrel 118 will pull upwardly while outer mandrel or setting sleeve 116 will remain static. The sloped engagement surface 120 of setting tool 62 will engage the sloped inner surface 100 of ball seat body 90 of ball seat 60. The upward pull will pull bottom shoe 52 upwardly, which causes a compressive force to be applied to frac plug 50. The setting sleeve engagement profile 122 of sloped engagement surface 120 is such that it causes radially outward deformation of ball seat 60. Ball seat 60 deforms in the sealing element 58 upon the application of the setting force applied by the setting tool 62. Once the frac plug 50 is moved to the set position the connection between the bottom shoe 52 and setting tool 62 will shear. The bottom shoe 52 will fall to the bottom of the well and the setting tool will be removed from the well.

In the prior art operation, a typical setting tool applies a force to the top surface of a ball seat body. The current disclosure describes a deformable ball seat 60 which is engaged on sloped inner surface 100 by a setting tool 62 with a sloped setting tool engagement surface.

When setting tool 62 is activated the sloped engagement surface 120 of setting tool 62 will engage sloped inner surface 100 of ball seat 60, which will deform ball seat 60 as depicted in FIGS. 6 and 7. The ball seat 60 is plastically deformable so that once expanded ball seat 60 will maintain its expanded shape to apply additional radially outwardly directed force to sealing element 58, which will aid in keeping frac plug 50 in its set position in casing 10. The plastically deformable ball seat 60 can be comprised of any suitable material that will hold its shape once deformed, for example but not limited to a low yield stainless steel. In the embodiment described the angle 124 defined by setting sleeve engagement profile 122 of sloped setting sleeve engagement surface 120 is greater than the first acute angle 104. As a result, the sloped inner surface 100 will be pushed radially outwardly so that a second acute angle 106 is defined by sloped inner surface 100 and longitudinal central axis 66. Second acute angle 106 is greater than first acute angle 104, and in one embodiment is the same as angle 124. FIGS. 6 and 7 include a dashed line depicting the orientation of sloped inner surface 100 in the unset position of the frac plug 50.

Once frac plug 50 is moved to the set position, and the setting tool 62 removed, a ball 130 may be dropped into the casing, and a fracturing operation as is known in the art may be performed thereabove.

Embodiments include:

Embodiment 1. A frac plug defining a central passage therethrough and movable from an unset to a set position in a well casing comprising a bottom shoe, a single slip ring assembly supported by the bottom shoe, a slip wedge positioned in slidable relationship to the single slip ring assembly, a sealing element supported by the slip wedge; and a deformable ball seat movable axially relative to the sealing element, the sealing element being expandable radially outwardly to engage and seal against the well casing upon the application of a force applied thereto by the deformable ball seat.

Embodiment 2. The frac plug of embodiment 1, the deformable ball seat comprising a plastically deformable ball seat.

Embodiment 3. The frac plug of any of embodiments 1-2, further comprising a setting tool removably connected to the bottom shoe and engageable with the deformable ball seat, the setting tool configured to apply a compressive force to the deformable ball seat to move the frac plug from the unset to the set position.

Embodiment 4. The frac plug of embodiment 3, further comprising an inner mandrel and a setting sleeve disposed about the inner mandrel, the setting sleeve having a setting tool engagement surface defining an acute setting tool engagement angle with a longitudinal axis of the frac plug, the setting tool engagement surface engageable with a ball seat engagement surface, the ball seat engagement surface defining a first acute angle with the longitudinal axis of the frac plug in the unset position of the frac plug.

Embodiment 5. The frac plug of embodiment 4, the first acute angle being less than the acute setting tool engagement angle.

Embodiment 6. The frac plug of embodiment 4, the first acute angle being the same as the acute setting tool engagement angle.

Embodiment 7. A frac plug defining a longitudinal central axis therethrough and movable from an unset to a set position in a well casing with a setting tool comprising a single slip ring movable radially outwardly to engage the well casing in the set position of the frac plug; a slip wedge slidable relative to the single slip ring to urge the single slip ring radially outwardly; a sealing element supported by the slip wedge and expandable radially outwardly to engage the well casing in the set position of the frac plug; and a deformable ball seat insertable into an upper opening of the sealing element.

Embodiment 8. The frac plug of embodiment 7, the deformable ball seat being deformable from a relaxed position to a deformed position in the sealing element upon the application of a setting force applied by the setting tool.

Embodiment 9. The frac plug of either of embodiments 7 or 8, further comprising a bottom shoe supporting the single slip ring.

Embodiment 10. The frac plug of embodiment 9, the setting tool comprising a connecting member detachably connected to the bottom shoe, an inner mandrel connected to the setting sleeve and a setting sleeve engageable with the deformable ball seat and movable relative to the inner mandrel to apply a setting force to the deformable ball seat.

Embodiment 11. The frac plug of embodiment 10, the setting sleeve defining a setting tool engagement surface that engages the deformable ball seat to move the frac plug to the set position, the setting tool engagement surface defining an acute angle with the longitudinal central axis of the frac plug.

Embodiment 12. The frac plug of embodiment 11, the setting tool engagement surface engaging a sloped ball seat engagement surface to move the frac plug to the set position.

Embodiment 13. The frac plug of any of embodiments 9-12, the setting tool comprising a removable setting tool connected to the bottom shoe.

Embodiment 14. The frac plug of any of embodiments 8-12, the deformable ball seat comprising a plastically deformable ball seat.

Embodiment 15. A frac plug movable from an unset to a set position with a setting tool in a well having a well casing therein comprising a bottom shoe, the setting tool detachably connected to the bottom shoe, a single slip ring supported by the bottom shoe and radially expandable to grippingly engage a wellbore wall, a slip wedge positioned above the slip ring, the slip ring axially movable relative to the slip wedge; a sealing element supported by the slip wedge and a deformable ball seat insertable into the sealing element, the deformable ball seat being plastically deformed upon the application of a setting force applied thereto by the setting tool.

Embodiment 16. The frac plug of embodiment 15, the setting tool comprising a sloped setting tool engagement surface, the sloped setting tool engagement surface defining an acute setting tool engagement angle with a longitudinal central axis of the frac plug wherein the sloped setting tool engagement surface engages a sloped ball seat engagement surface.

Embodiment 17. The frac plug of embodiment 16, the deformable ball seat having a top surface and a generally conically shaped inner surface, the generally conically shaped inner surface comprising the sloped ball seat engagement surface.

Embodiment 18. The frac plug of any of embodiments 16-17, the setting tool comprising a connecting member detachably connected to the bottom shoe, an inner mandrel connected to the connecting member and a setting sleeve disposed about the inner mandrel, the setting tool engagement surface being defined on the setting sleeve.

Embodiment 19. The frac plug of any of embodiments 16-18, the sloped ball seat engagement surface defining a first acute angle with the longitudinal central axis in the unset position of the frac plug, the first acute angle being different than the acute setting tool engagement angle.

Embodiment 20. The frac plug of any of embodiments 15-19, the deformable ball seat being a plastically deformable ball seat.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A frac plug system comprising:

a frac plug defining a central passage therethrough and movable from an unset to a set position in a well casing, the frac plug comprising;

a bottom shoe;

a single slip ring assembly supported by the bottom shoe;

a slip wedge positioned in slidable relationship to the single slip ring assembly;

a sealing element supported by the slip wedge; and a deformable ball seat movable axially relative to the sealing element, the sealing element being expandable radially outwardly to engage and seal against the well casing upon the application of a force applied thereto by the deformable ball seat; and a setting tool removably connected to the bottom shoe and engageable with the deformable ball seat, the setting tool configured to apply a compressive force to the deformable ball seat to deform the deformable ball seat and to move the frac plug from the unset to the set position.

2. The frac plug system of claim 1, the deformable ball seat being a plastically deformable ball seat.

3. The frac plug system of claim 1, the setting tool comprising:

an inner mandrel; and a setting sleeve disposed about the inner mandrel, the setting sleeve having a setting tool engagement surface defining an acute setting tool engagement angle with a longitudinal axis of the frac plug, the setting tool engagement surface engageable with a ball seat engagement surface, the ball seat engagement surface defining a first acute angle with the longitudinal axis of the frac plug in the unset position of the frac plug.

4. The frac plug system of claim 3, the first acute angle being less than the acute setting tool engagement angle.

5. The frac plug system of claim 3, the first acute angle being the same as the acute setting tool engagement angle.

6. A frac plug system comprising:

a frac plug defining a longitudinal central axis therethrough and movable from an unset to a set position in a well casing upon the application of a setting force, the frac plug comprising:

a single slip ring movable radially outwardly to engage the well casing in the set position of the frac plug;

a slip wedge slidable relative to the single slip ring to urge the single slip ring radially outwardly;

a sealing element supported by the slip wedge and expandable radially outwardly to engage the well casing in the set position of the frac plug;

a deformable ball seat insertable into an upper opening of the sealing element, the deformable ball seat having a sloped ball seat engagement surface; and a setting tool, the deformable ball seat being deformed radially outwardly into the sealing element upon the application of the setting force by the setting tool to the sloped ball seat engagement surface.

7. The frac plug system of claim 6, the deformable ball seat being deformable from a relaxed position to a deformed position in the sealing element upon the application of the setting force to the frac plug.

8. The frac plug system of claim 6 further comprising a bottom shoe supporting the single slip ring.

9. The frac plug system of claim 6, the setting tool comprising:

a connecting member detachably connected to the bottom shoe;

an inner mandrel connected to the connecting member; and a setting sleeve engageable with the deformable ball seat and movable relative to the inner mandrel to apply the setting force to the deformable ball seat engagement surface.

10. The frac plug system of claim 9, the setting sleeve defining a setting tool engagement surface that engages the deformable ball seat to deform the deformable ball seat and move the frac plug to the set position, the setting tool engagement surface defining an acute angle with the longitudinal central axis of the frac plug.

11. The frac plug system of claim 9, the setting tool being a removable setting tool connected to the bottom shoe.

12. The frac plug system of claim 6, the deformable ball seat being a plastically deformable ball seat.

13. A frac plug system comprising:

a frac plug movable from an unset to a set position in a well having a well casing therein upon the application of a setting force, the frac plug comprising;

a bottom shoe, the setting tool detachably connected to the bottom shoe;

a single slip ring supported by the bottom shoe and radially expandable to grippingly engage a wellbore wall;

a slip wedge positioned above the slip ring, the slip ring axially movable relative to the slip wedge;

a sealing element supported by the slip wedge; and a deformable ball seat insertable into the sealing element, the deformable ball seat having an upward facing sloped ball seat engagement surface and being deformed radially outwardly into the sealing element upon the application of a setting force to the sloped ball seat engagement surface; and a setting tool operably associated with the frac plug, the setting tool configured to apply the setting force to the sloped ball seat engagement surface.

14. The frac plug system of claim 13, the setting tool comprising a sloped setting tool engagement surface, the sloped setting tool engagement surface defining an acute setting tool engagement angle with a longitudinal central axis of the frac plug wherein the sloped setting tool engagement surface engages the sloped ball seat engagement surface.

15. The frac plug system of claim 14, the deformable ball seat having a top surface and a conically shaped inner surface, the conically shaped inner surface comprising the sloped ball seat engagement surface.

16. The frac plug system of claim 14, the setting tool comprising:

a connecting member detachably connected to the bottom shoe;

an inner mandrel connected to the connecting member; and a setting sleeve disposed about the inner mandrel, the setting tool engagement surface being defined on the setting sleeve.

17. The frac plug system of claim 14, the sloped ball seat engagement surface defining a first acute angle with the longitudinal central axis in the unset position of the frac plug, the first acute angle being different than the acute setting tool engagement angle.

18. The frac plug system of claim 13, the deformable ball seat being a plastically deformable ball seat.

* * * * *